United States Patent [19]

Cogbill, II

[11] 4,248,253

[45] Feb. 3, 1981

[54] METHOD FOR SEPARATING VEINS FROM LAMINA OF TOBACCO LEAF

[75] Inventor: Philip H. Cogbill, II, Pineville, N.C.

[73] Assignee: Brown & Williamson Tobacco Corp., Louisville, Ky.

[21] Appl. No.: 47,424

[22] Filed: Jun. 11, 1979

[51] Int. Cl.[3] ..... A24B 5/10

[52] U.S. Cl. ..... 131/146; 131/140 R

[58] Field of Search ..... 131/146, 145, 140 R, 131/140 C; 241/236

[56] References Cited

U.S. PATENT DOCUMENTS

| | | | |
|---|---|---|---|
| 3,513,858 | 5/1970 | Piotrucci | 131/146 |
| 4,000,748 | 1/1977 | Summers | 131/140 C |

*Primary Examiner*—Stephen C. Pellegrino

*Attorney, Agent, or Firm*—Charles G. Lamb; William J. Mason

[57] ABSTRACT

A system and process for removing the veins from bulk strip tobacco utilizing an attrition mill having a pair of spaced discs therein wherein one of the discs is rotatable and the other is stationary. The attrition mill is utilized to mill the bulk strip tobacco prior to the separation of the veins from the lamina.

10 Claims, 5 Drawing Figures

METHOD FOR SEPARATING VEINS FROM LAMINA OF TOBACCO LEAF

BACKGROUND OF THE INVENTION (1) Field of the Invention

This invention relates to a method for separating veins from the lamina of the tobacco leaf. More particularly, this invention relates to a process for improving the fill power of tobacco in a cigarette product by removing the veins from the lamina.

(2) Description of the Prior Art

In the processing of tobacco leaves for use in cigarettes, it is common for the leaf of tobacco to be run through a series of milling devices wherein the stem of the tobacco is removed from the lamina which includes the small vein portions therein. (As used hereinafter "stem" refers to the main stem or rib which extends through the individual pieces of lamina, and "vein" refers to the short stem pieces that are attached to the main stem or rib.) In the aforementioned processing of the leaf, milling devices are used with a classifying or a screening device disposed downstream after each milling operation wherein the lamina, including the veins, are caught in one section and the tobacco stems are caught in another section for further processing. The lamina, including the veins, are then generally further processed for use in the manufacture of cigarettes. In the further processing of the lamina, which includes the veins, the bulk lamina is generally cut into small pieces wherein the veins remain for use in cigarettes. These veins, when the lamina is cut, add density to the "fill power" of the tobacco and furthermore give a "birds eye" appearance in the small pieces of lamina, the "birds eye" being a portion of the lamina as seen along the axial cut of the vein.

In the prior art, U.S. Pat. No. 3,074,415; U.S. Pat. No. 3,126,014; New Zealand Patent No. 139,007; and U.S. Pat. No. 3,367,342, describe different methods and apparatuses for size reduction by threshing to remove large stems. And, U.S. Pat. No. 4,074,722 teaches a process for manufacturing smokable tobacco products through selective handling of strip tobacco based on particle size and shape. However, none of these patents teach a process or method for selectively removing the veins from the lamina.

SUMMARY OF THE INVENTION

It is an object of the present invention to provide a method and apparatus for removing veins from the lamina in a bulk strip of tobacco wherein the "mid" ribs or stems have previously been removed. It is another object of this invention to provide an apparatus and a process to generate a small strip product from bulk strip tobacco wherein the end product has a relatively high fill power. It is even another object of this invention to provide an apparatus and a process for the removing of veins from the lamina wherein a relatively low percentage of fines or dust is produced. Other objects and advantages of this invention will become apparent to those skilled in the art upon consideration of the accompanying disclosure.

The present invention resides in the recognition that small strip tobacco of improved fill value can be generated from leaf tobacco if the stems and veins are removed. The small stems or veins may be removed by running bulk strip through a disc or attrition mill or a hammermill and then through separating means for separating the lamina from the veins. It has been found that the improvement in fill value exceeds the amount of vein material removed. In the milling step of the process, it has been found that preferred mills include attrition or disc mills and hammermills operated under preselected operating conditions. As used in the invention, an attrition or disc mill is one including a pair of spaced discs wherein one of the discs is rotatable and the other is stationary, with the spacing between the discs being critical.

According to the present invention, one preferred process for removing the veins from bulk strip tobacco, including lamina and veins, comprises the steps of hammermilling the bulk strip tobacco through a discharge screen having openings therein of from about 5/16 to $\frac{3}{4}$ inch; then, separating the veins from the lamina which have been stripped from the lamina through the hammermilling step. Separating generally includes a classifying device, such as a tower air classifier wherein the veins settle to the bottom and the lighter lamina is airveyed out through the top or side, then screening the resulting lamina material through a double-screen, including a $\frac{1}{4}$ inch screen disposed above a screen of 14-mesh, or smaller. Preferably, the hammermill is provided with at least one row of hammers disposed in parallel having a width of from about $\frac{1}{4}$ inch to $\frac{1}{2}$ inch with about $\frac{1}{2}$ inch to $1\frac{1}{2}$ inches spacing between the hammers; and, the mill rotates at from 650 to 1500 r.p.m.

Another preferred process for removing the veins from bulk strip tobacco, including lamina and veins, comprises the steps of milling the tobacco through a disc mill wherein the disc mill includes a pair of spaced discs, one rotatable and the other stationary, then separating the veins from the lamina as discussed hereinbefore. Preferably, the attrition discs are from about 12 to 48 inches in diameter and the rotatable disc rotates at a speed of approximately from about 800 to 1300 r.p.m. with a gap between the discs being from 0.050 to 0.100 inches.

It is to be understood that the description of the examples of the present invention given hereinafter are not by way of limitation and various modifications within the scope of the present invention will occur to those skilled in the art upon reading the disclosures set forth hereinafter.

BRIEF DESCRIPTION OF THE DRAWINGS

Referring to the drawing.

DESCRIPTION OF THE PREFERRED EMBODIMENT

Figure 1:
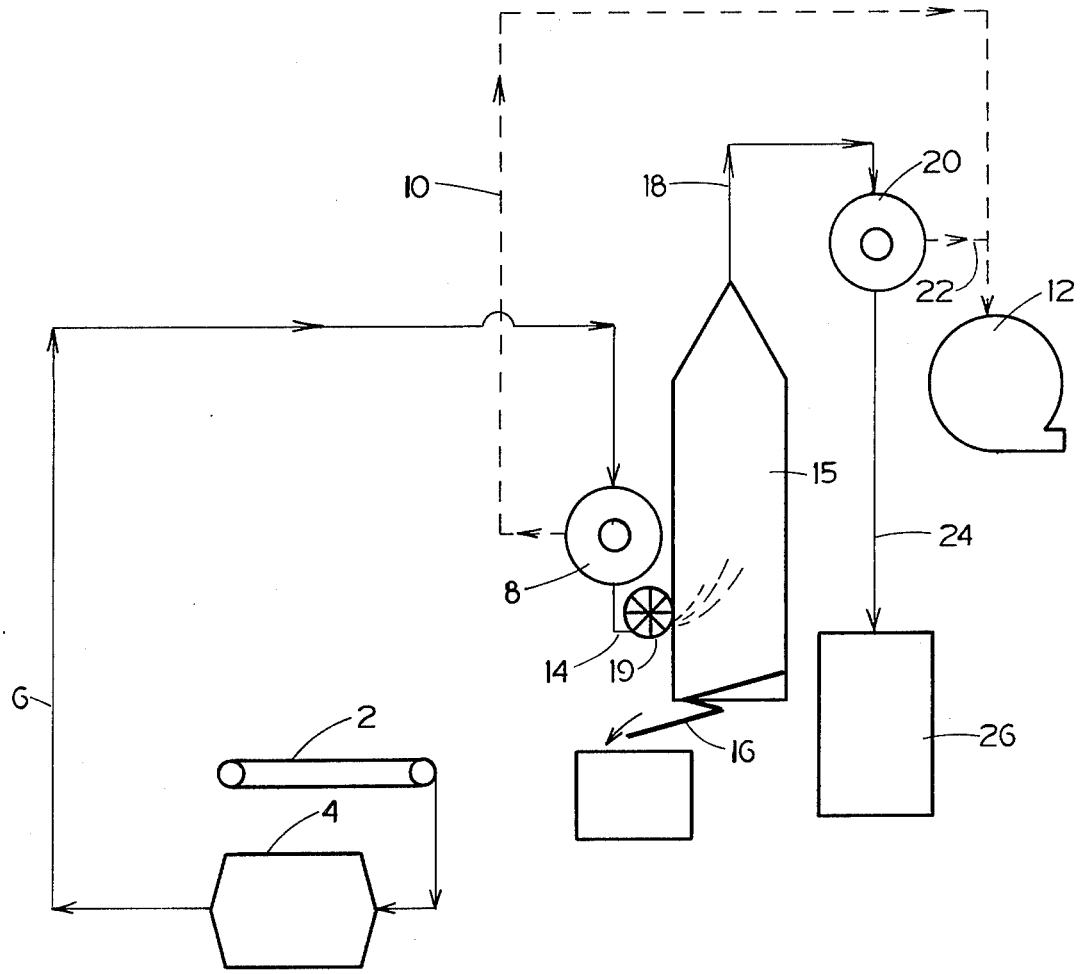
FIG. 1 is a schematic flow diagram illustrating one apparatus and process for removing the veins from bulk strip tobacco, including lamina and veins, in accordance with the present invention.

In FIG. 1, bulk strip tobacco is fed by a feed conveyer 2 to a mill 4 (to be discussed hereinafter), which may be either an attrition (disc) mill (FIG. 4) or a hammermill (FIG. 3), wherein the product discharging therefrom is pneumatically conveyed through conduit 6 to a centrifugal separator 8. In the separator 8, which may be any known in the art, the dust is separated from the lamina and veins wherein the dust is then conveyed from the separator 8 through line 10 by means of fan 12 to a reclaiming or collection device (not shown) for further processing. It is noted that fan 12 is also utilized to pull the air through a tower classifier 15 and a second centrifugal separator 20, to be discussed hereinafter. The rest of the material, specifically the lamina and the veins, from the centrifugal separator 8 is then conveyed through line 14, which includes an air lock 17 (FIG. 5) and an accelerator 19, accelerator 19 being motorized (not shown) to throw the material horizontally into the air stream of a tower air classifier 15. In the air classifier 15, the veins are separated from the lamina, the veins being removed through the bottom by conveyor 16; and, the lamina product, which includes a small portion of dust, is removed through the air stream out the top of the tower air classifier 15 through line 18. As best shown in FIG. 5, the conveyor 16 includes a vibrating screen therein and a damper 21 is provided in the outgoing air stream of the air classifier 15 to regulate flow through the tower 15, air entering the tower 15 through louvered opening 23. The exiting product from tower 15 is further separated in a second centrifugal separator 20. The dust is removed from the centrifugal separator 20 through line 22 and the product at the bottom of the centrifugal separator 20 is removed through line 24 and is received in a product receptacle 26. The product in receptacle 26 is substantially free of veins and is then usable as small strip for cigarette production.

Figure 2:
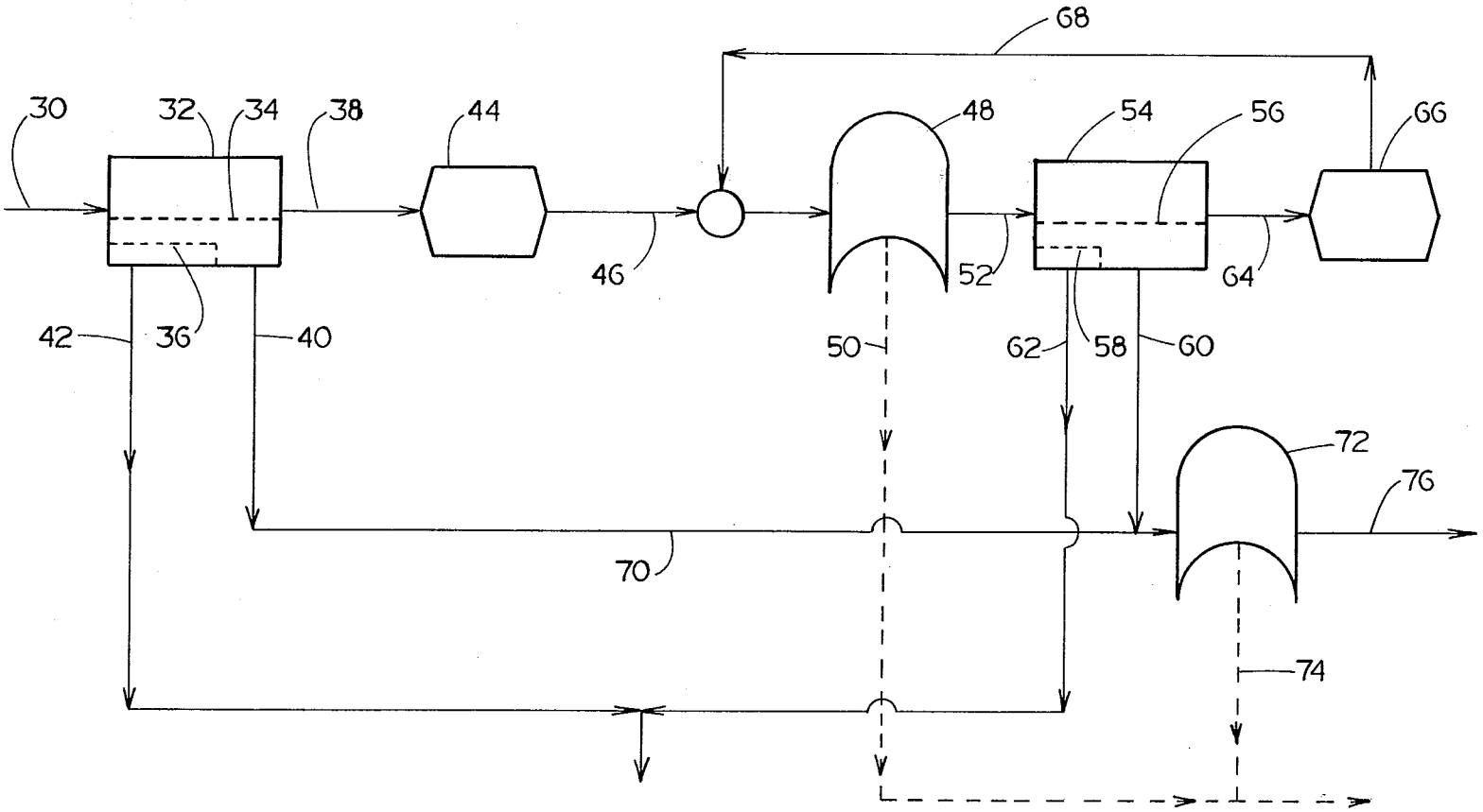
FIG. 2 is another preferred schematic flow diagram illustrating an apparatus and process for removing the veins from bulk strip tobacco, including lamina and veins, in accordance with the present invention.

In FIG. 2, bulk strip tobacco is fed through line 30 to a double screening device 32, which includes a $\frac{1}{4}$ inch screen 34 and a 20-mesh screen 36 therein. The overs from the $\frac{1}{4}$ inch screen are removed to a milling device through line 38, to be discussed hereinafter, wherein the material caught on the 20-mesh screen 36, which is between $-\frac{1}{4}$ inch and +20-mesh, is removed through line 40 for further processing in air classifier 72 where the veins are separated from the lamina. The veins are removed out of the bottom of the unit through discharge line 74 and mixed with other veins as discussed hereinafter. All of the material which passes through the 20-mesh screen 36 is then removed through line 42 as dust for further processing (not shown), which is generally recovering means for use as feed for reconstituted tobacco. De-veined material (product) is removed by air-veying through line 76 for use as feed for cigarette products.

The overs, which are $+\frac{1}{4}$ inch material, are then fed through conduit 38 to mill 44, which may be either an attrition (disc) mill (FIG. 4) or a hammermill (FIG. 3), wherein the $+\frac{1}{4}$ inch material from conduit 38 is then milled and removed through conduit 46 to an air classifier 48 wherein the veins are removed from the product stream through line 50 for mixing with the veins removed from classifier 72 through line 74. The product from the air classifier 48 is then removed through conduit 52 to a double screen device 54, which includes a $\frac{1}{4}$ inch screen 56 and a 20-mesh screen 58 therein. The overs from the $\frac{1}{4}$ inch screen are removed to a milling device through line 64, to be discussed hereinafter, wherein the material caught on the 20-mesh screen, which is between $-\frac{1}{4}$ inch and +20-mesh, is removed through line or conduit 60 and fed to air classifier 72 with the $-\frac{1}{4}$ inch and +20-mesh material from line 40 as discussed herein previously. It is realized that the material in conduit 60 has been de-veined and may be used directly as feed for cigarette products, but in a preferred step, the material in conduit 60 still includes a small amount of veins and is thereby subjected to an additional separating step in air classifier 72. All of the material which passes through the 20-mesh screen 58 is then removed through line 62 as dust for further processing (not shown), which is generally recovering means for use as feed for reconstituted tobacco.

The overs, which are $+\frac{1}{4}$ inch material, as mentioned previously, are then fed through conduit 64 to a mill 66, which may be either an attrition mill or a hammermill wherein the $+\frac{1}{4}$ inch material from line 64 is shattered with the material being removed through line 68 for blending with the material from the first hammermill 44 and further processing as discussed hereinbefore.

Figure 3:
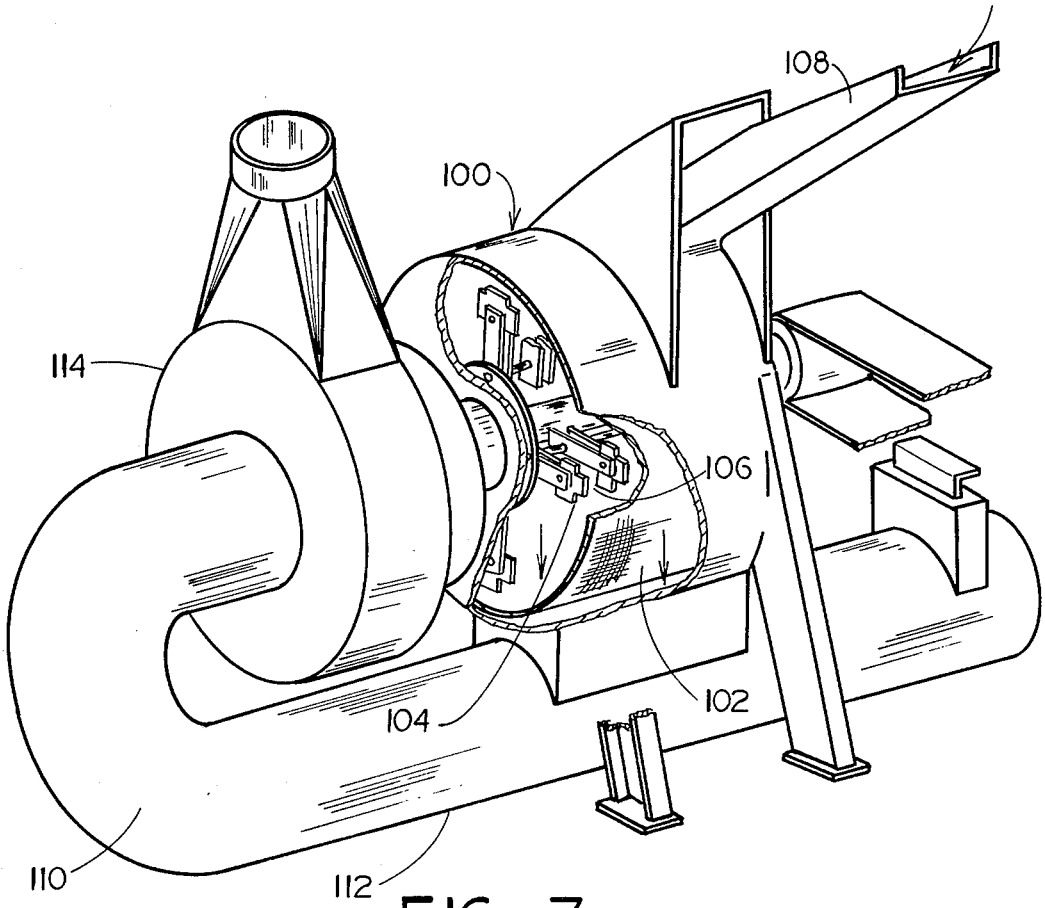
FIG. 3 is a perspective view, with selected portions cut-away, illustrating a hammermill which may be used in the present invention.

In FIG. 3 is shown a typical hammermill 100 which may be utilized in the present invention. As discussed hereinbefore, the hammermill may be any presently available in the prior art, but the discharge screen 102 must be provided with openings from between 5/16 and $\frac{3}{4}$ inch; the hammers 104 are from $\frac{1}{4}$ to $\frac{1}{2}$ inch in width with about $\frac{1}{2}$ to $1\frac{1}{2}$ inch spacings therebetween, as noted by the numeral 106; and, the hammers rotate at from 650 to 1500 revolutions per minute, driving means for the hammers being any driving means known in the art. Operating outside the aforementioned ranges results in the production of either a high dust content or insufficient separation of the veins from the lamina.

The hammermill 100 is further provided with a feed chute 108 for feeding tobacco to the mill and an air-veying system 110 for removing the milled tobacco therefrom. The air-veying system 110 is provided with an air duct 112 and a blower 114, which is shown enclosed.

Figure 4:
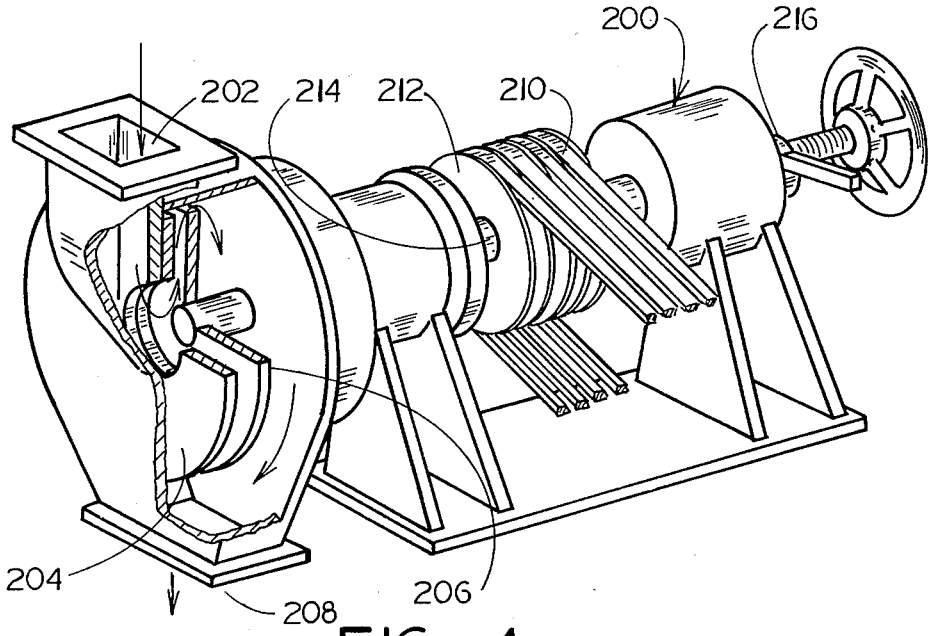
FIG. 4 is a perspective view, with selected portions cut-away, illustrating a disc-mill which may be used in the present invention.
Figure 5:
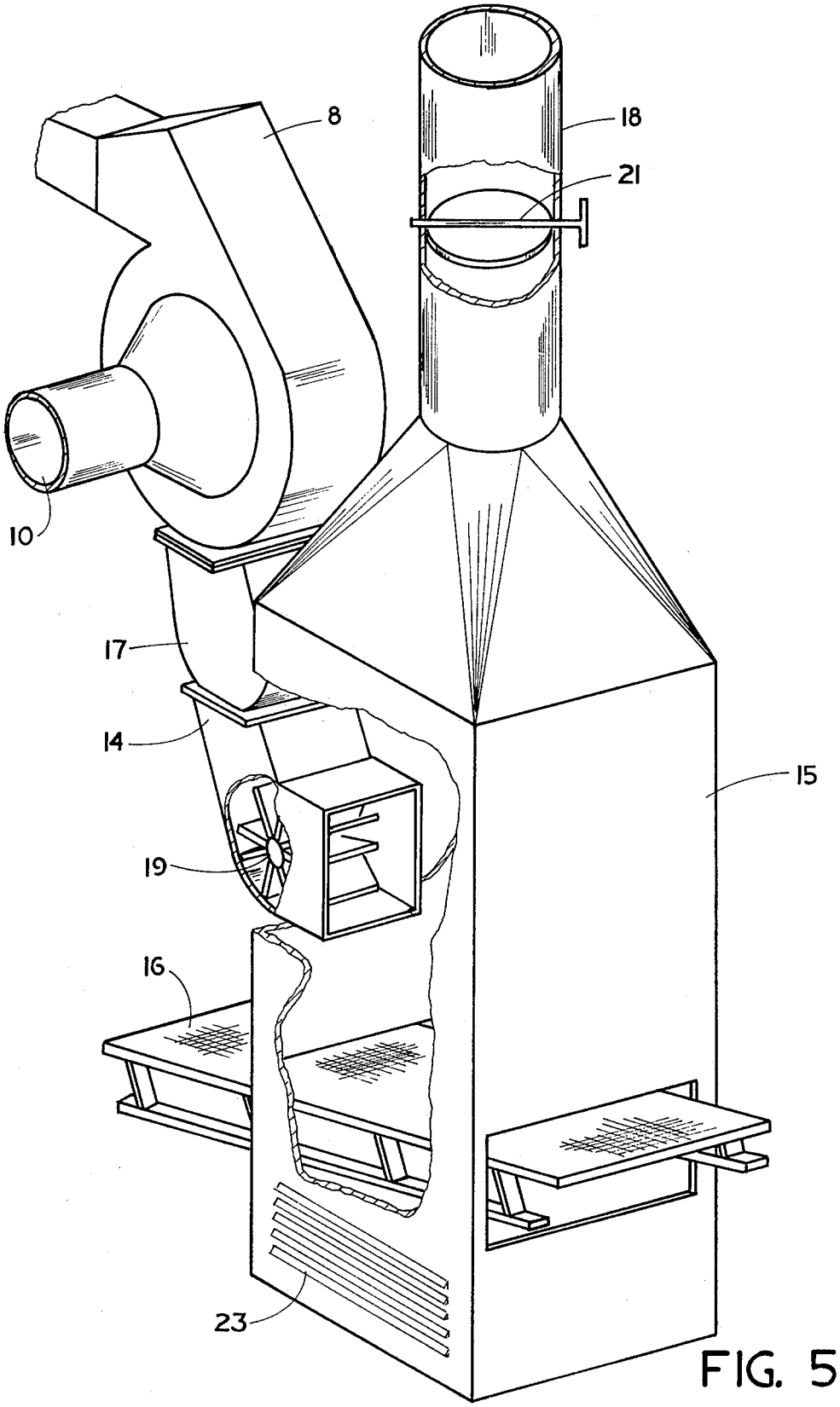
FIG. 5 is a perspective view, with selected portions cut-away, illustrating a tower air classifier and a centrifugal separator which may be used in the present invention.

In FIG. 4 is shown a typical disc or attrition mill 200 which may be utilized in the present invention. As discussed hereinbefore, the disc mill may be any presently available in the prior art. However, it is realized that the spacings between the discs and the rotatable speed of the rotatable disc are critical. In FIG. 4, material to be milled is fed into mill 200 through feed inlet 202 and passes between the stationary disc 204 and the rotatable disc 206. The discs 204 and 206 are from about 12 to 48 inches in diameter and the rotatable disc 206 rotates at a speed of from about 800 to 1300 r.p.m. It has been found that in this range, in order to obtain an acceptable product, the spacing between the discs should be from about 0.050 to 0.100 inches.

The milled tobacco, after separation of the veins from the lamina, is discharged through outlet 208.

The mill 200 is driven by any known measn, but is shown as being pulley driven by pulleys 210 and sheaves 212, the driving means not being shown. Sheaves 212 are mounted onto a shaft 214 at one end and at the other end of the shaft is mounted the rotatable disc 206. Adjusting means as represented by the numeral 216, which may be any known in the art for adjusting the pulleys and sheaves, is not discussed in detail herein.

Thus, it will be realized that various changes may be made to the specific embodiment shown and described without departing from the scope and spirit of the present invention.

What is claimed is:

1. A process for removing the veins from bulk strip tobacco, including lamina and veins, comprising the steps of: milling said bulk strip tobacco through an attrition mill including a pair of spaced parallel discs wherein one of the discs is rotatable and the other is stationary; and, separating the veins from the lamina.

2. The process of claim 1 wherein the discs are from about 12 to 48 inches in diameter and the rotatable disc rotates at a speed of from about 800 to 1300 r.p.m.

3. The process of claim 2 wherein the spacings between said discs are from about 0.050 to 0.100 inches.

4. The process of claim 1 wherein said separating includes air-veying said milled tobacco through a vertical tower at a flow rate sufficient to convey the lighter lamina through the tower and insufficient to convey the heavier veins through the tower.

5. The process of claim 1 including the step of screening the separated lamina through a double-screen having a ¼ inch screen and less than a 14-mesh screen, said ¼ inch screen being disposed above said less than a 14-mesh screen.

6. A process for removing the veins from bulk strip tobacco, including lamina and veins, comprising the steps of: milling said bulk strip tobacco through a first attrition mill including a pair of spaced parallel discs wherein one of the discs is rotatable and the other is stationary; removing veins from said material; screening the resulting lamina material through a double-screen including a ¼ inch and less than a 14-mesh screen, said ¼ inch screen being disposed above said less than a 14-mesh screen; dividing the lamina into over ¼ inch size material, material between ¼ inch and less than 14-mesh size, and under the less than 14-mesh size material; passing said overs through a second attrition mill including a pair of spaced discs wherein one of the discs is rotatable and the other is stationary; and, returning said milled material to said process prior to said screening.

7. A system for removing the veins from bulk strip tobacco comprising: a disc mill including a pair of spaced parallel discs of from about 12 to 48 inches in diameter therein, one of said discs being rotatable, the other of said discs being stationary, the spacing between said discs being from about 0.050 to 0.100; means to rotate said rotatable disc at from 800 to 1300 revolutions per minute; feed means for said disc mill; discharge means from said disc mill; and, air-veying means in flow communication with the discharge means of said disc mill to tobacco separating means, said tobacco separating means including means to separate the veins from the lamina.

8. The system of claim 7, said tobacco separating means including a tower air classifier, said classifier having tobacco feed means in the side thereof, an opening in the top portion thereof in flow communication with blower means, an opening in the bottom portion thereof with discharge means, and means for bringing air into said tower.

9. The system of claim 8 including a centrifugal separator disposed in cooperating relation with said tobacco feed means to said tower.

10. The system of claim 7, said tobacco separating means including a double screen, said double-screen including a ¼ inch screen and less than a 14-mesh screen, said ¼ inch screen being disposed above said less than a 14-mesh screen.

* * * * *